US008042807B2

(12) United States Patent
Biegelsen et al.

(10) Patent No.: US 8,042,807 B2
(45) Date of Patent: Oct. 25, 2011

(54) TRANSPORT FOR PRINTING SYSTEMS

(75) Inventors: David K. Biegelsen, Portola Valley, CA (US); David G. Duff, Woodside, CA (US); Erik L. Swartz, Sunnyvale, CA (US); Ashish V. Pattekar, Cupertino, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 265 days.

(21) Appl. No.: 11/614,370

(22) Filed: Dec. 21, 2006

(65) Prior Publication Data

US 2008/0150229 A1 Jun. 26, 2008

(51) Int. Cl.
*B65H 5/02* (2006.01)

(52) U.S. Cl. ..... 271/272

(58) Field of Classification Search ..... 271/264, 271/272; 101/11, 40, 40.1, 43, 44, 53, 118, 101/225, 227, 228, 224, 231, 232, 272, 276, 101/278, 279, 416.1, 420, 415.1; 492/39, 492/22, 30, 33, 42, 37; 406/88; 226/181, 226/182, 183, 185, 186, 189, 190, 191, 193
See application file for complete search history.

(56) References Cited

U.S. PATENT DOCUMENTS

| | | | | | |
|---|---|---|---|---|---|
| 1,553,352 | A | * | 9/1925 | Amidon et al. | 101/23 |
| 1,935,522 | A | * | 11/1933 | Prior | 83/886 |
| 3,417,692 | A | * | 12/1968 | Brodie | 101/352.13 |
| 3,643,598 | A | * | 2/1972 | Papa et al. | 101/420 |
| 4,614,632 | A | * | 9/1986 | Kezuka et al. | 264/280 |
| 4,961,378 | A | * | 10/1990 | Balow et al. | 101/142 |
| 5,102,118 | A | * | 4/1992 | Vits | 271/195 |
| 5,152,522 | A | * | 10/1992 | Yamashita | 271/264 |
| 5,598,778 | A | * | 2/1997 | Iijima et al. | 101/181 |
| 5,611,275 | A | * | 3/1997 | Iijima et al. | 101/181 |
| 5,924,619 | A | * | 7/1999 | Bartell | 226/7 |
| 6,619,795 | B1 | * | 9/2003 | Hiramatsu | 347/104 |
| 6,631,608 | B1 | * | 10/2003 | Eykelkamp | 56/15.6 |
| 6,884,205 | B2 | * | 4/2005 | VanNoy et al. | 492/37 |

(Continued)

FOREIGN PATENT DOCUMENTS

| | | | |
|---|---|---|---|
| GB | 2 238 525 | | 5/1991 |
| JP | 58-109353 | | 6/1983 |
| JP | 58109353 | A * | 6/1983 |

(Continued)

*Primary Examiner* — Jeremy R Severson
(74) *Attorney, Agent, or Firm* — Marger Johnson & McCollom, P.C.

(57) ABSTRACT

A transport system for cut sheet media has a first and second cylinder to form a nip, a support subsystem to transport edges of cut sheets having at least one image into and out of the nip, and an array of contact points on each cylinder to make contact with the cut sheets without marking the image. A wheel for a print medium transport system has an outer rim having a series of contact points, an inner hub supporting a means to accommodate a drive shaft, and an internal spring connecting the outer rim to the inner hub. A method of transporting cut sheets in a printing system forms a nip between at least one pair of cylinders, each cylinder having an array of contact points, guides a first edge of a cut sheet into the nip, and uses the arrays of contact points to transport the cut sheets through one of either a fusing or drying process.

14 Claims, 6 Drawing Sheets

U.S. PATENT DOCUMENTS

| | | | | |
|---|---|---|---|---|
| 2001/0014244 | A1 | 8/2001 | Parthasarathy et al. | |
| 2003/0172822 | A1 * | 9/2003 | Langsch | 101/228 |
| 2003/0193127 | A1 | 10/2003 | Ishibashi | |
| 2004/0003732 | A1 * | 1/2004 | Kobayashi et al. | 101/228 |
| 2005/0068401 | A1 | 3/2005 | Aoki | |
| 2006/0181020 | A1 | 8/2006 | Numao | |

FOREIGN PATENT DOCUMENTS

| | | |
|---|---|---|
| WO | 90/02656 | 3/1990 |
| WO | 2005/047000 | 5/2005 |

* cited by examiner

TRANSPORT FOR PRINTING SYSTEMS

BACKGROUND

Transport of cut sheets with wet or molten images on one or both sides requires negligible interaction between the transport means and the images. Interaction between the transport system and the images may result in alteration of the images if the transport system marks the images prior to drying, solidifying, or fusing the image onto the paper. Fully non-contacting transport using air jets requires continuous closed-loop feedback and jet control to achieve sufficient control of sheet transport. Such a system can be prohibitively expensive. It is therefore a benefit of the present embodiments to provide an open loop, in the sense that no sheet position sensing is required, relatively inexpensive and virtually non-contacting means to transport sheets with wet or molten images thereon.

Interaction may also cause transfer of the marking material, such as ink or toner, to the transport system. When the transport system transports a different sheet, the marking material may transfer onto the other sheet, leaving a ghost image of the previous sheet's image on the new sheet.

In addition, cut sheets, such as individual pages of paper, may have issues related to cockling or curling of the sheets as they are transported. Generally, contactless fusing, where the media moves through a fusing process to fix the image onto the media, may involve knives of gases or vapors for heating, drying and cooling the media. For a web medium that comes in large rolls, this may not be as much of a problem because tension in the roll assists in keeping the medium flat. It may become more difficult to keep cut sheets of media flat in a contactless system.

SUMMARY

A first embodiment is transport system for cut sheet media having a first and second cylinder to form a nip, a support subsystem to transport edges of cut sheets having at least one image into and out of the nip, and an array of contact points on each cylinder to make contact with the cut sheets without marking the image.

Another embodiment includes a wheel for a print medium transport system having an outer rim having a series of contact points, an inner hub supporting a means to accommodate a drive shaft, and an internal spring connecting the outer rim to the inner hub.

Another embodiment is a method of transporting cut sheets in a printing system. The method forms a nip between at least one pair of cylinders, each cylinder having an array of contact points, guides a first edge of a cut sheet into the nip, and uses the arrays of contact points to transport the cut sheets through one of either a fusing or drying process.

BRIEF DESCRIPTION OF THE DRAWINGS

Embodiments of the invention may be best understood by reading the disclosure with reference to the drawings, wherein.

DETAILED DESCRIPTION OF THE EMBODIMENTS

Figure 1:
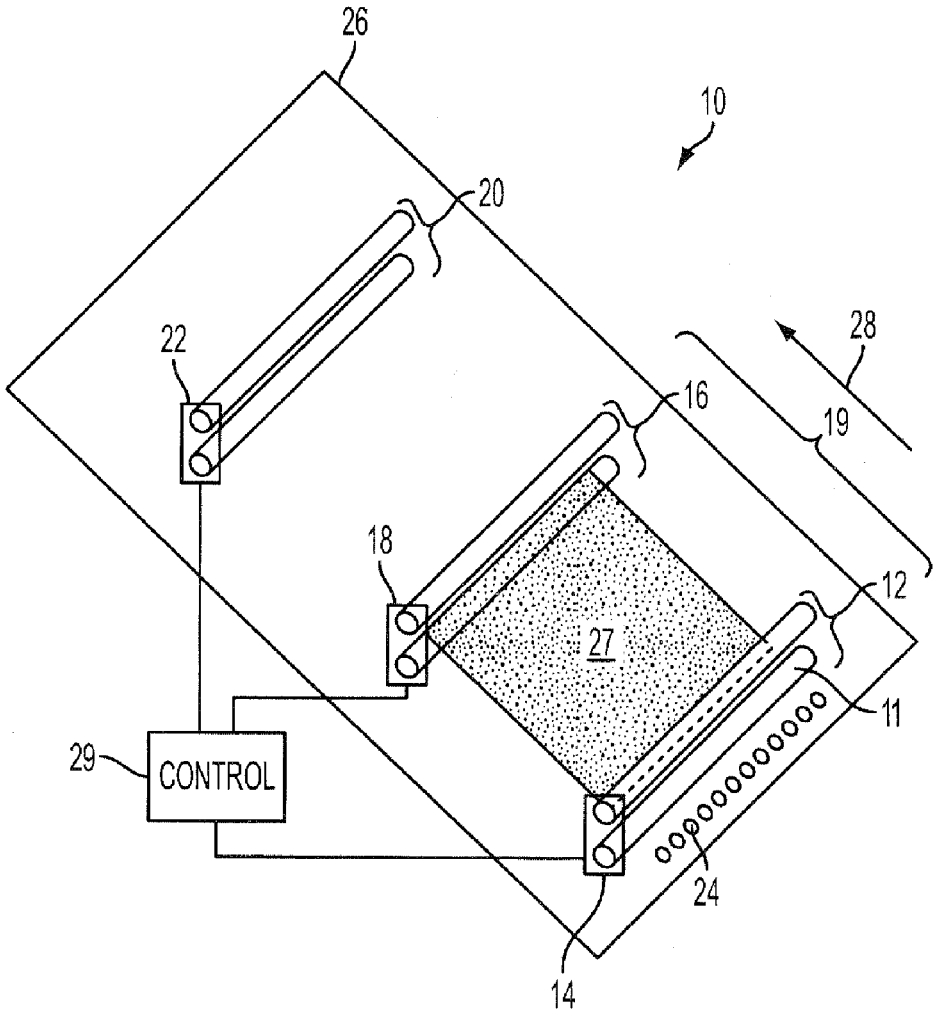
FIG. 1 shows an example of a transport system for a web print medium.

FIG. 1 shows a transport system for a cut sheet printing system. A cut sheet printing system means a system in which the print media, also referred to as printing substrates, feed into the system in individual sheets in contrast to a web fed system in which the medium feeds into the system from rolls. The transport system may include one or more pairs of cylinders, such as 12, 16 and 20, or may include one.

Each pair of cylinders, such as pair 12, has two cylinders arranged adjacent to each other to form a nip. Nip as used here means the region between two cylinders where at least a portion of each cylinder is in contact with the print media. As will be discussed in more detail later, in embodiments disclosed here, a portion of the cylinder consists of contact points and only those come into contact with the print media.

In the transport system of FIG. 1, a sheet of media 27 feeds into a first pair of cylinders 12. The transport system 10 may include a support subsystem 26. The support subsystem in this embodiment uses air or steam jets or knives, such as 24, or mechanical guides (not shown) which contact only the leading edge of curled sheets, to guide the sheet 27 into the nip formed by the pair of cylinders 12. The support subsystem controls the edges of the sheets so they do not flap and come into contact with other portions of the system prior to the images becoming permanently fixed onto the media. The support subsystem, by whatever means employed, also maintains the print media in a flat state to minimize cockling or curling.

The first pair of cylinders has a motor 14 for turning the cylinders to allow the print media to move along in the process direction 28. The print media has an image, such as a tacked but unfused toner image, a molten image or a wet image, that undergoes a fusing process as it moves through the transport system. The maximum distance of one cylinder pair from the next pair of cylinders may depend upon a shortest sheet length used in the system. This ensures that sheets do not 'fall' out of the transport system during the fusing process.

In addition to each pair of cylinders 12, 6 and 20 optionally having their own motors 14, 18 and 22, the system may also have a motion control 29 to alter the relative motions of the cylinders for tensioning purposes in the system. For example, to tension sheets as they are transported, sequential nips can be driven at slightly higher speed than the upstream nips for a short time to wind up the torsional compliance of the cylinders. Then the nips can be maintained at the same speed for the rest of the time that the sheet is within the grasp of both nips. The cylinders may also all be driven by the same motor, but altering the relative motion of one or the other pairs of cylinders would not be as easily accomplished. In one embodiment, where starwheels having internal springs form the arrays of contact points, speeding up each successive pairs of cylinders to be slightly faster than a previous pair of cylinders tensions the internal springs and produces process direction tensioning of the sheets held by the cylinder pairs.

Figure 2:
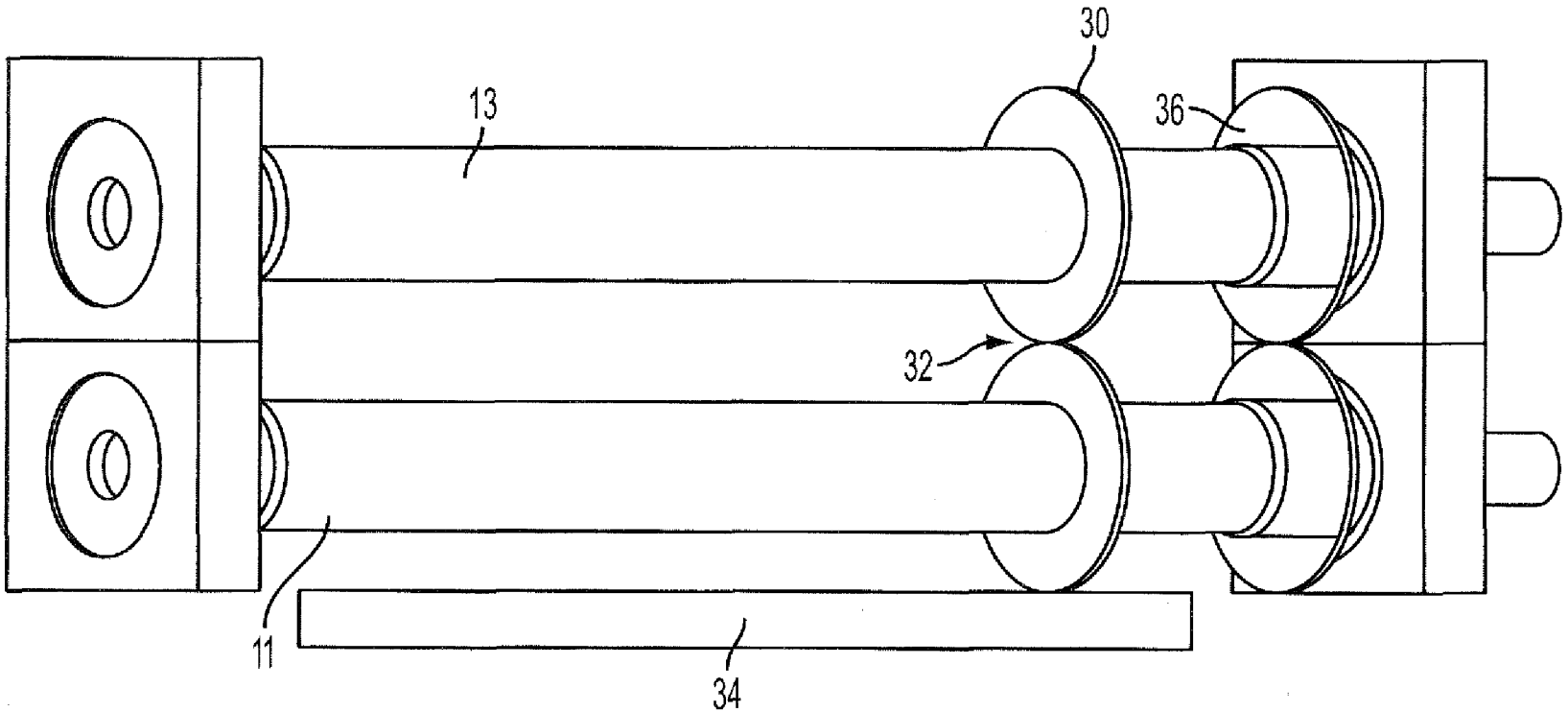
FIG. 2 shows an example of a pair of cylinders with arrays of contact points.

FIG. 2 shows a more detailed view of the pair of cylinders 12. In this embodiment, the pair of cylinders 11 and 13 has arrays of contact points provided by starwheels such as 30. The nip 32 lies between the two starwheels. Alternatively, the arrays of contact points may also be provided by rotating brushes, punctured or formed metal having a 'cheese grater' like appearance, or belts having points on their surfaces. In a similar embodiment the points on the lower cylinder are offset axially from those on the upper cylinder. The nip is then defined by the axially projected alignment of the cylinders.

Figure 3:
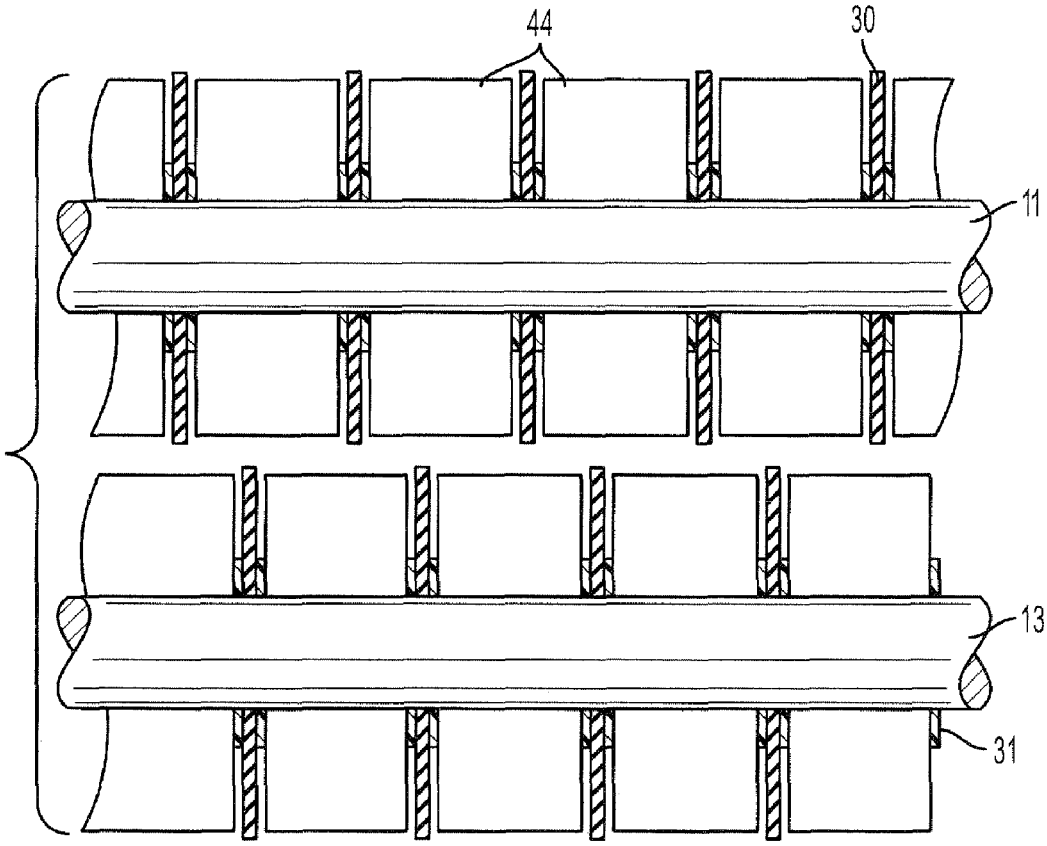
FIG. 3 shows an example of a pair of cylinders having offset arrays of contact points offset in a lateral direction.

The arrays of contact points on one cylinder may be offset from the array of contact points on the other cylinder in the pair. The example of FIG. 3 shows drive shaft 11 having a first set of disks such as 30, offset laterally some fraction of the distance between the disks such as 31 on the drive shaft 13. This may result in even lighter contact on the print medium, reducing even further the possibility of marking. The addition of spacers 44 in between the disks and having diameters somewhat less than the diameter of the disks also allows the outer rim of the disk to be pressed away from the nip center while remaining protected from over extension by the spacers.

The array of contact points has the characteristic that each point makes light contact with the sheet and image on the sheet in such a manner as not to alter or mark the image. Experiments have determined that the amount of force applied to the print media that will cause visible marking or alteration of the sheet is approximately 80 grams (for typical coated paper media). Using an array of contact points, each point makes contact with the media using much less force than 80 grams, and spreading the light contact out across several points of contact allows sufficient force to be applied to the media to cause it to be controllably transported.

Returning to FIG. 1, the motor 14, not shown in FIG. 2, may drive only one of the cylinders. For example, the motor may drive only cylinder 13, and drive wheels or gears such as 36, use contact to drive the second cylinder 11. This ensures that the two cylinders move at the same speed. Generally the circumferential speed of the cylinders will match the linear speed of the media.

Employing the pairs of cylinders such as 12 may also allow better control of the support subsystem. As shown in FIG. 1, the region between pairs 12 and 16 may form a region 19 in which it is desirable to conserve steam and/or hot air. A barrier wall as shown in FIG. 3 may be interdigitated with the arrays of contact points, shown in FIG. 3 as starwheels 30, to form a barrier between zones. The interdigitated wall 40 has gaps such as 32 to accommodate the arrays of contact points and still allow minimal leakage of vapor or air past the barrier.

Figure 4:
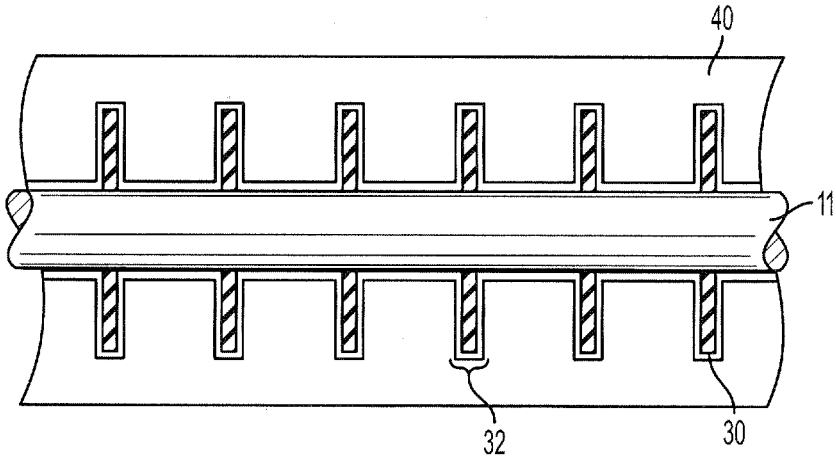
FIG. 4 shows an example of a cylinder forming part of an interdigitated wall.

FIG. 4 also shows that the arrays of contact points may be a series of starwheels, or disks, along the cylinder 11. FIG. 2 had most of them removed for ease of viewing. The actual distance between disks on each shaft and whether it is non-uniform or constant is left up to the system designer for the printing applications for which the system is being designed. In the example of FIG. 4, the series of disks on each cylinder form the arrays of contact points.

The arrays of contact points should have sufficient compliance so that the system can accommodate different thicknesses of print media. Because both sides of the sheet may have unfused toner, molten or wet inks, one cannot use large area resilient contacts on either side. It would be expensive to have compliant shafts for each disk in a series, and alignment of the shafts would be critical. One embodiment has compliancy built into the disks, as will be discussed in more detail further.

Figure 5:
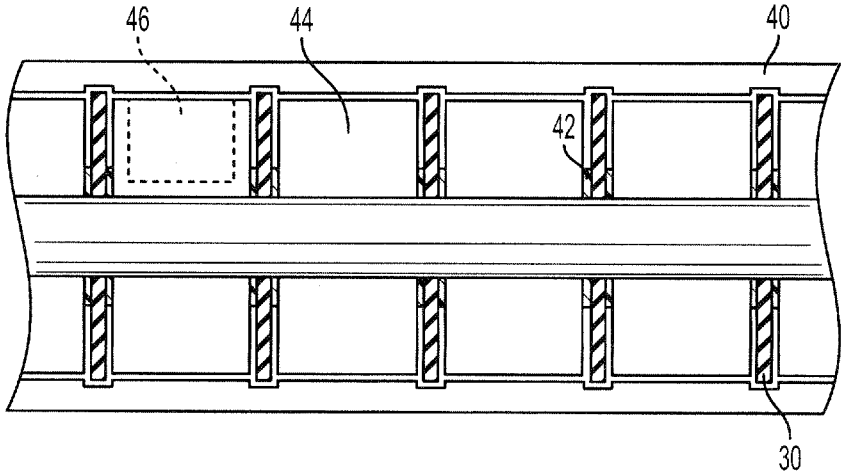
FIG. 5 shows an example of a cylinder having disks forming arrays of contact points with lateral support.

If compliant disks are used, some reinforcement of the disks may be necessary in the lateral dimension to ensure that the disks do not shift. FIG. 5 shows one embodiment of reinforcing the disks in the lateral dimension. The shaft 11 has the disks such as 30 mounted on it, with hub shim washers such as 42 on either side of each disk. Large spacers such as 44 limit the side travel of the outer rims of the compliant disks, as well as acting as seals for the inter-zone boundaries. If the pair of cylinders is not being used as a boundary, the spacers 44 can be cut away or assembled from several annular spacers to allow fluidic flow past the disks as shown by the region in the dotted lines 46.

The use of compliant disks allows the arrays of contact points to deflect or offset inward as needed to accommodate thicker media. Generally, the cylinders will be arranged such that the width of the gap at the nip is slightly less than the thinnest media accommodated by the system. The thinnest media accommodated by the system will be referred to as the minimum thickness. The cylinders will be arranged such that the array of contact points will be separated by a distance smaller than the minimum thickness. When the media moves into the gap, the compliant disks will displace to allow passage of the media with minimum contact.

Figure 6:
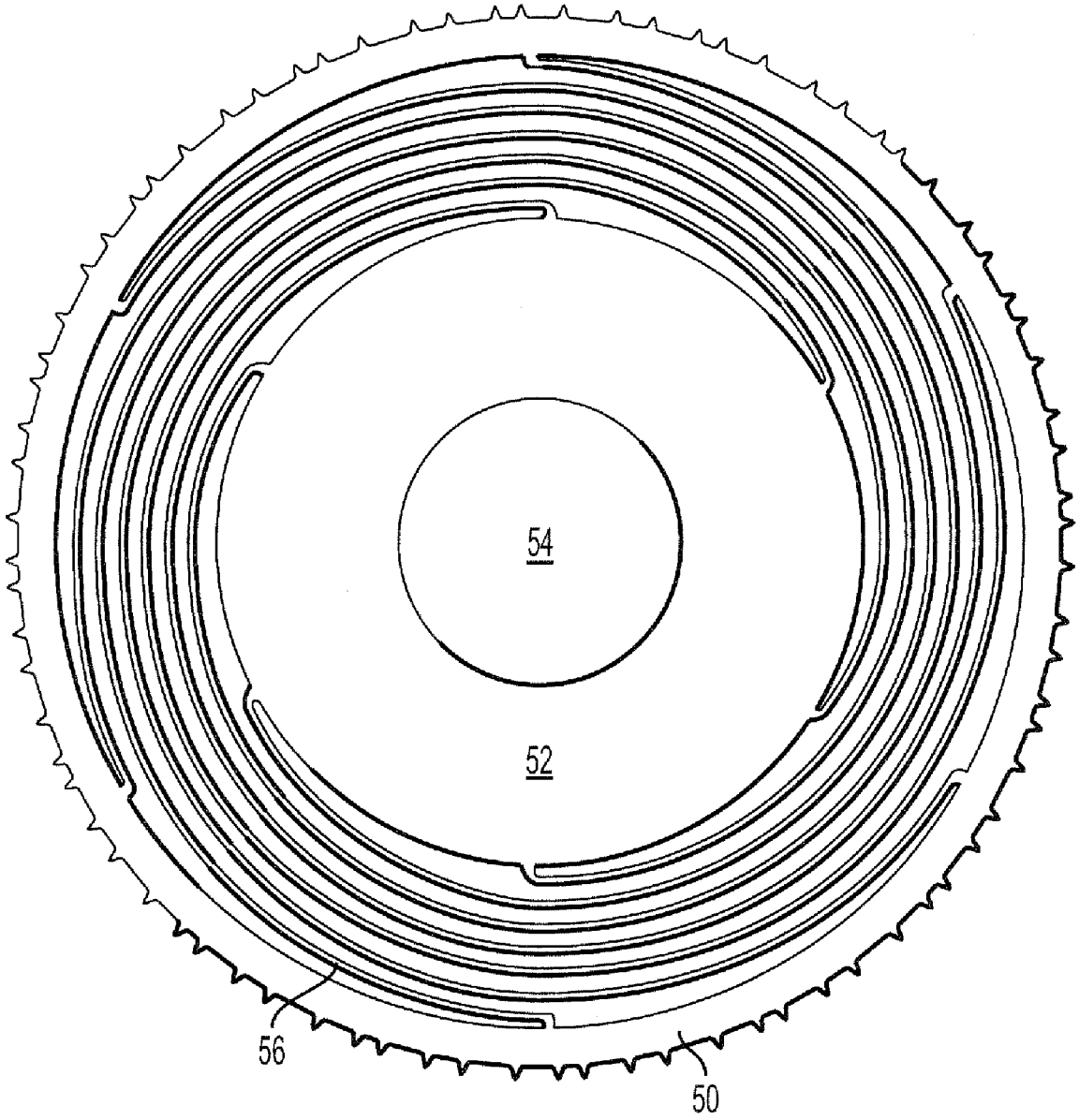
FIG. 6 shows an example of a starwheel.

FIG. 6 shows an example of a compliant disk or wheel. Because of the array of contact points on the outer rim, the structure may be referred to as a 'starwheel.' The starwheel has an outer rim 50 that contains the array of contact points. Internal springs 56 connect the outer rim 50 to the inner hub 52. Inner hub 52 can also have a hole 54 to accommodate the shaft, such as 11 from FIG. 4. Relative azimuthal orientation between starwheels on a given shaft or between shafts need not be fixed and is in fact preferably random. The brain identifies patterns most readily when the elements are regular. Therefore randomness is desirable for hiding any otherwise perceptible marking effects. In a similar manner the points on the outer rim are preferably positioned pseudo-randomly about the circumference of the starwheel. In the embodiment of FIG. 6, the internal spring 56 has several springs that are in the same plane as the inner and outer rims, that is, the springs are 'flat' to the disk.

Internal springs, and spiral springs in particular, provide several advantages. The springs allow the outer rim 50 to deflect or offset from thicker media to control the contact force of any one point against the image. In addition, the springs can accommodate small intermittent differential speeds between different starwheel assemblies contacting the same sheet. These speed differentials may result from speed control errors, or from a purposeful adjustment of speeds to tension the sheet. As mentioned previously, the speed control may have each successive pair of cylinders run slightly faster than the previous sheet to tension the springs in the process direction. This may assist in maintaining the flatness of the sheet in printing processes where water content varies and slack sheets may allow fiber realignment to occur.

Figure 7:
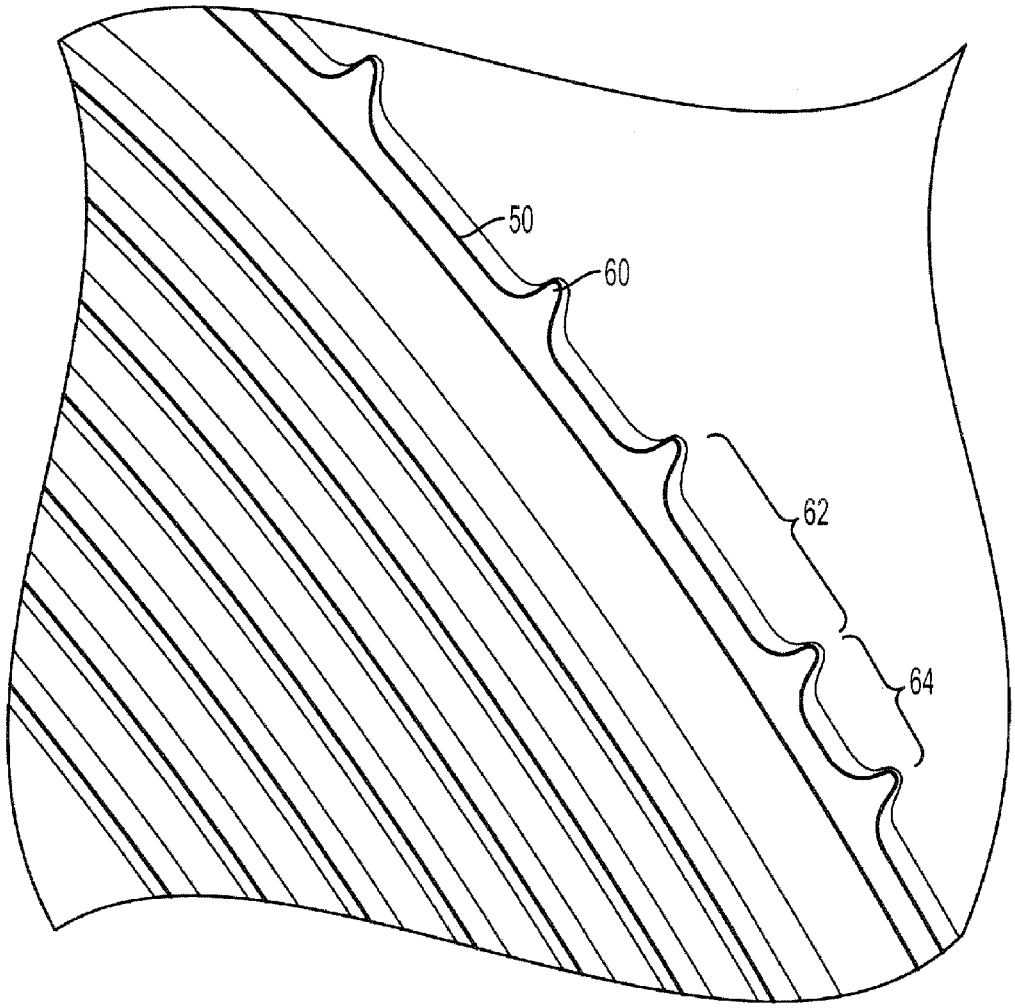
FIG. 7 shows a detailed view of a starwheel.

FIG. 7 shows a more detailed view of the teeth placement around the outer rim of the disk. The outer rim 50 has a plurality of contact points, or 'teeth,' such as 60. The distance between the points varies in a pseudo-random manner. For example, the distance 62 differs from distance 64. Starwheel disks can be made in many ways. A preferred way uses photochemical etching of thin steel sheets. Two-sided imaging allows a symmetrical etching of the teeth. Other manufacturing means, such as laser machining, are well known to those skilled in the manufacturing arts.

In addition, no alignment features exist for the disks when they slide onto the shaft, resulting in random azimuthal placement. The combination of pseudo-random teeth placement and random azimuthal placement mitigates the tendency of the human brain to detect patterns in an image or document when viewed at the natural reading distance.

Experiments using stainless steel disks approximately 125 microns thick showed no tendency to leave visible marks on the images. The experiments also did not result in any transfer of marking material to the disks, also referred to as 'hot offset.' If hot offset is shown to be an issue under particular conditions such as for certain toners or inks, various methods, such as coating with fluoro-hydrocarbons can be used to alleviate the problem by reducing the surface energy of at least a portion of the wheel, such as the tips. The coatings may also increase wear strength of the wheels Returning to FIG. 2, a fixture 34 may operate to clean the arrays of points, such as a cleaning brush or a solvent bath or roll. In addition to, or as an alternative to, a cleaning fixture, the fixture 34 may accommodate a recoating subsystem. The fixture 34 may have a contact roll wetted with Teflon® depositing liquids. Running the disks at a slightly elevated temperature would cause thin layers of Teflon to form on the points. Teflon layers could also result from corona deposition or electro-spraying.

In this manner, a virtually 'contactless' transport system is provided for a fusing or drying process in a print system employing cut sheets. Arrays of contact points spread the force necessary to move the media, while limiting the amount of force that occurs at any one point, eliminating marking of the image or sheet or transferring of the marking material.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A transport system for cut sheet media, comprising:

a first and second cylinder arranged so as to form a nip;

a support subsystem to transport edges of cut sheets having at least one image into and out of the nip; and an array of contact points of one of brushes, belts with points, punctured metal or starwheels, on each cylinder extending from a surface of the cylinder, the array of contact points to contact the cut sheets, such that only the array of contact points contact the cut sheets;

wherein:

the first and second cylinders are disposed such that the surface of the first cylinder is separated from the surface of the second cylinder by a distance greater than a sum of a distance from the surface of the first cylinder to a distal end of a longest contact point of the first cylinder and a distance from the surface of the second cylinder to a distal end of a longest contact point of the second cylinder when the contact points contact the cut sheets; and for each of the first and second cylinders, a combined surface area of distal ends of the contact points is less than a surface area of the surface of the cylinder.

2. The transport system of claim 1, wherein the support subsystem further comprises a fluidic bearing means.

3. The transport system of claim 2, wherein the fluidic bearing means comprises at least one of air knives, air jets, steam knives or steam jets.

4. The transport system of claim 1, comprising a motor to drive the first cylinder and a drive wheel between the first and second cylinders to drive the second cylinder at a same speed as the first cylinder.

5. The transport system of claim 1, the transport system comprising multiple pairs of first and second cylinders arranged along a process direction, where each of the first and second cylinders of the pairs includes a corresponding array of contact points.

6. The transport system of claim 5, the transport system comprising a speed control to operate each pair of cylinders with rotational motions slightly different from that of a previous pair of cylinders.

7. The transport system of claim 1, the transport system comprising a barrier interdigitated with the arrays of contact points to form a zone in the transport system;

wherein the barrier is offset from sides of the contact points such that the contact points can deform an amount before contacting the barrier.

8. The transport system of claim 1, wherein the array of contact points on the first cylinder is offset in a lateral direction by a fraction of the distance between contact points on the second cylinder shaft.

9. The transport system of claim 1, wherein the contact points of at least one of the first cylinder and the second cylinder are disposed in random locations.

10. The transport system of claim 1, wherein for each of the first cylinder and the second cylinder, the cylinder includes a plurality of disks disposed along the cylinder and the contact points of the cylinder are disposed on outer rims of the disks.

11. The transport system of claim 10, wherein at least one disk of the first cylinder and the second cylinder includes:

an inner hub to accommodate a drive shaft; and an internal spring connecting the outer rim to the inner hub, the internal spring lying in the plane of the outer rim and the inner hub, the internal spring to allow the outer rim to translate inward towards the inner hub.

12. The transport system of claim 10, wherein at least one disk of the first cylinder and the second cylinder is compliant.

13. The transport system of claim 10, wherein for each of the first cylinder and the second cylinder, the disks of the cylinder have random relative azimuthal orientations.

14. The transport system of claim 10, wherein for each disk, the contact points of the disk extend from the outer rim of the disk.

* * * * *